US011598595B2

(12) United States Patent
Wall et al.

(10) Patent No.: US 11,598,595 B2
(45) Date of Patent: Mar. 7, 2023

(54) MODULAR BUSHING ADAPTER BOLT ACTION ASSEMBLY FOR INTERCHANGING BARRELS

(71) Applicants: Robin Wall, San Antonio, TX (US); Ashley Diamond, San Antonio, TX (US)

(72) Inventors: Robin Wall, San Antonio, TX (US); Ashley Diamond, San Antonio, TX (US)

(73) Assignee: Robin Wall, San Antonio, TX (US)

( * ) Notice: Subject to any disclaimer, the term of this patent is extended or adjusted under 35 U.S.C. 154(b) by 0 days.

(21) Appl. No.: 17/503,136

(22) Filed: Oct. 15, 2021

(65) Prior Publication Data

US 2022/0205746 A1 Jun. 30, 2022

Related U.S. Application Data

(60) Provisional application No. 63/092,103, filed on Oct. 15, 2020.

(51) Int. Cl.

| | |
|---|---|
| ***F41A 3/66*** | (2006.01) |
| ***F41A 21/48*** | (2006.01) |
| ***F41A 3/26*** | (2006.01) |
| ***F41C 23/16*** | (2006.01) |
| ***F41A 15/16*** | (2006.01) |

(52) U.S. Cl.
CPC ..... *F41A 3/66* (2013.01); *F41A 3/26* (2013.01); *F41A 15/16* (2013.01); *F41A 21/485* (2013.01); *F41C 23/16* (2013.01)

(58) Field of Classification Search
CPC ..... F41A 3/66; F41A 21/485
See application file for complete search history.

(56) References Cited

U.S. PATENT DOCUMENTS

| | | | | |
|---|---|---|---|---|
| 8,739,449 | B2 * | 6/2014 | Patel | F41C 23/16 42/75.02 |
| 9,003,684 | B2 * | 4/2015 | Bero | F41A 21/485 42/16 |
| 9,658,020 | B2 * | 5/2017 | Daniel | F41A 21/487 |
| 9,664,465 | B1 * | 5/2017 | Viviano | F41A 15/12 |

FOREIGN PATENT DOCUMENTS

| | | | | |
|---|---|---|---|---|
| WO | WO-2021001523 | A1 * | 1/2021 | F41A 11/02 |

* cited by examiner

*Primary Examiner* — Reginald S Tillman, Jr.
(74) *Attorney, Agent, or Firm* — Pete Adams Law, PLLC

(57) ABSTRACT

The modular upper receiver assembly for firearms is an adapter allowing interchanging of barrels of different calibers to attach to an upper receiver assembly. The adapter assembly serves to provide a quick changeover coupling means for connecting an assortment of barrels of different calibers and lengths to the receiver. The coupling includes a barrel retaining bushing and adapter pair with threaded surfaces on the receiver for a threaded engagement, reinforced with threaded fastener compression for improved rigidity.

4 Claims, 9 Drawing Sheets

20

MODULAR BUSHING ADAPTER BOLT ACTION ASSEMBLY FOR INTERCHANGING BARRELS

CROSS-REFERENCE TO RELATED APPLICATIONS

This is a U.S. Nonprovisional Patent Application filed under 35 U.S.C. 111(b) and claiming priority to U.S. Provisional Patent Application No. 63,092,103, filed Oct. 15, 2020.

BACKGROUND OF THE INVENTION

1. Field of the Invention

The present invention relates generally to firearms. More specifically, it relates to a modular bushing adapter bolt action assembly incorporating a system and method for quick barrel changes using a threaded adapter to allow for the installation of other pre-manufactured barrels of assorted calibers.

2. Description of Related Art

Proper alignment of the barrel and receiver in firearms is an important factor bearing upon the reliability, safety, and accuracy of the firearm. It is desirable for the barrel and receiver to be properly aligned and securely joined in such a manner that the two joined components are nearly as rigid as a single member, in order to withstand the force of bullet projectiles. The assembly must also withstand the recoil force that occurs with engagement of the firearm. Prior methods of, and means for, attaching the barrel and receiver include pinning or bolting the barrel to the receiver by means of an external fastener, and attaching the barrel to the receiver by threading. Pinning and bolting do not produce a union that approaches the theoretical rigidity of a single member, thus limiting the accuracy of the firearm, when attempting to install new barrels on an AR-15, AR-10, and M-16.

A further need exists for a receiver system to be capable of accepting multiple lengths of barrels or different calibers on the same receiver platform. In prior art, the ability to change calibers or barrel lengths could only be achieved by swapping the entire upper receiver or by changing the barrels at user level rather than by an armorer. Prior products require the entire barrel and bushing assembly to be installed with specific corresponding upper receivers per each desired caliber. Accordingly, a need remains for an improved method, and means for, attaching the barrel of a firearm to a universal receiver and rail extension hand guard.

Not only is a means for quick barrel changeover desirable, but a barrel changeover also eliminates the need for a gunsmith or proprietary tools to adapt the firearm to a new caliber. Further, a modular bushing adapter assembly capable of receiving barrels from a variety of manufacturers is desirable and cost effective for firearm consumers, rather than requiring barrels specifically made for a particular type of receiver.

SUMMARY OF THE INVENTION

The invention generally pertains to a modular upper receiver assembly for firearms. The system is an adapter enabling interchanging of barrels of different calibers to attach to the upper receiver assembly. The adapter assembly serves to provide a quick changeover coupling means for connecting an assortment of barrels of different calibers and lengths to the receiver. The coupling means includes a barrel retaining bushing and adapter pair with threaded surfaces on the receiver for a threaded engagement, reinforced with threaded fastener compression for improved rigidity.

The adapter assembly includes novel components such as an upper receiver, a barrel nut, and a rail extension hand guard. The adapter assembly is designed to retrofit in a preexisting barrel and bolt carrier group for firearms such as an AR-15, M-16, AR-10, and the like. A firearm user can implement the adapter assembly in the preexisting complete lower receiver of a firearm, as well as the corresponding preexisting barrel and bolt assemblies for the desired caliber.

DETAILED DESCRIPTION OF THE INVENTION

Figure 1:
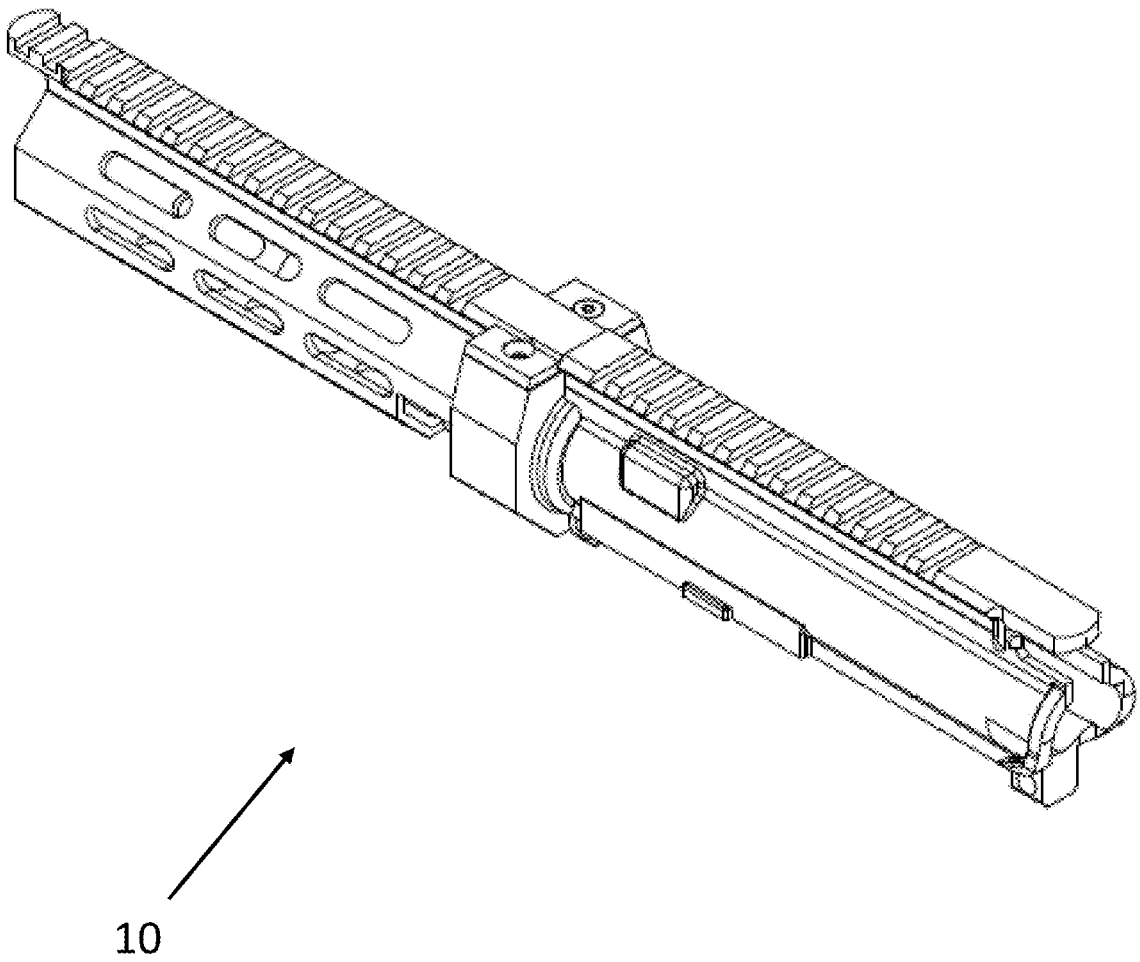
FIG. 1 illustrates a perspective view of an embodiment of a modular bushing adapter assembly.

The following descriptions relate principally to preferred embodiments while a few alternative embodiments may also be referenced on occasion, although it should be understood that many other alternative embodiments would also fall within the scope of the invention. The embodiments disclosed are not to be construed as describing limits to the invention, whereas the broader scope of the invention should instead be considered with reference to the claims, which may be now appended or may later be added or amended in this or related applications. Unless indicated otherwise, it is to be understood that terms used in these descriptions generally have the same meanings as those that would be understood by persons of ordinary skill in the art. It should also be understood that terms used are generally intended to have the ordinary meanings that would be understood within the context of the related art, and they generally should not be restricted to formal or ideal definitions, unless and only to the extent that a particular context clearly requires otherwise. Synonymous or equivalent terms may be used in different instances in the specification and should not be construed to limit the invention.

For purposes of these descriptions, a few wording simplifications should also be understood as universal, except to the extent otherwise clarified in a particular context either in the specification or in particular claims. The use of the term "or" should be understood as referring to alternatives, although it is generally used to mean "and/or" unless explicitly indicated to refer to alternatives only, or unless the alternatives are inherently mutually exclusive. Furthermore, unless explicitly dictated by the language, the term "and" may be interpreted as "or" in some instances. When referencing values, the term "about" may be used to indicate an approximate value, generally one that could be read as being that value plus or minus half of the value. "A" or "an" and the like may mean one or more, unless clearly indicated otherwise. Such "one or more" meanings are most especially intended when references are made in conjunction with open-ended words such as "having," "comprising" or "including." Likewise, "another" object may mean at least a second object or more. Thus, in the context of this specification, the term "comprising" is used in an inclusive sense and thus should be understood as meaning "including, but not limited to." As used herein, the use of "may" or "may be" indicates that a modified term is appropriate, capable, or suitable for an indicated capacity, function, or usage, while considering that in some circumstances the modified term may sometimes not be appropriate, capable, or suitable. Directional terms such as left, right, front, rear, top, and bottom are non-limiting and do not restrict the invention to particular orientations. Example quantities and sizing dimensions are described herein but do not limit the invention, as other sizes and quantities can be implemented. "Plurality" means one or more in this specification and any claims.

FIG. 1 illustrates a perspective view of an embodiment of a modular bushing adapter assembly 10. The modular bushing adapter assembly 10 can be implemented in rifles such as the AR-15, AR-10, M-16, M-4, and the like. The adapter assembly 10 shown is an example embodiment but it can also be modified for use in pistols and other firearms. The modular bushing adapter assembly 10 (aka universal bolt action assembly) enables a firearm user to quickly switch (interchange) the caliber implemented in the firearm. This is a substantial improvement in the field because the adapter assembly 10 eliminates the need to employ a gunsmith or propriety tools for interchanging the caliber.

Figure 2:
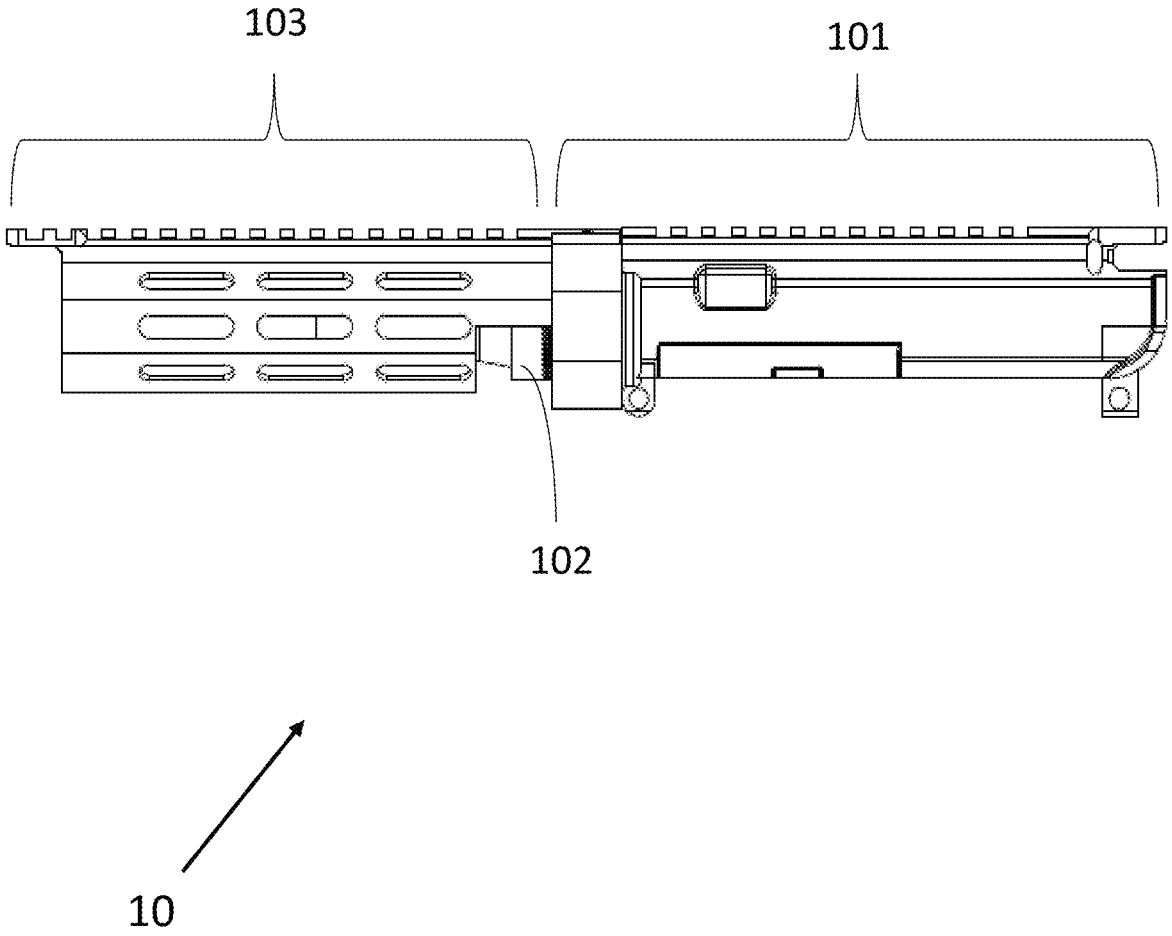
FIG. 2 illustrates a side view of the modular bushing adapter assembly.

FIG. 2 illustrates a side view of the modular bushing adapter assembly 10. The adapter assembly 10 includes novel components such as an upper receiver 101, a barrel nut 102, and a rail extension hand guard 103. The adapter assembly 10 is designed to retrofit in a preexisting barrel and bolt carrier group for firearms such as an AR-15, M-16, AR-10, and the like. A firearm user can implement the adapter assembly 10 in the preexisting complete lower receiver of a firearm, as well as the corresponding preexisting barrel and bolt assemblies for the desired caliber.

Figure 3:
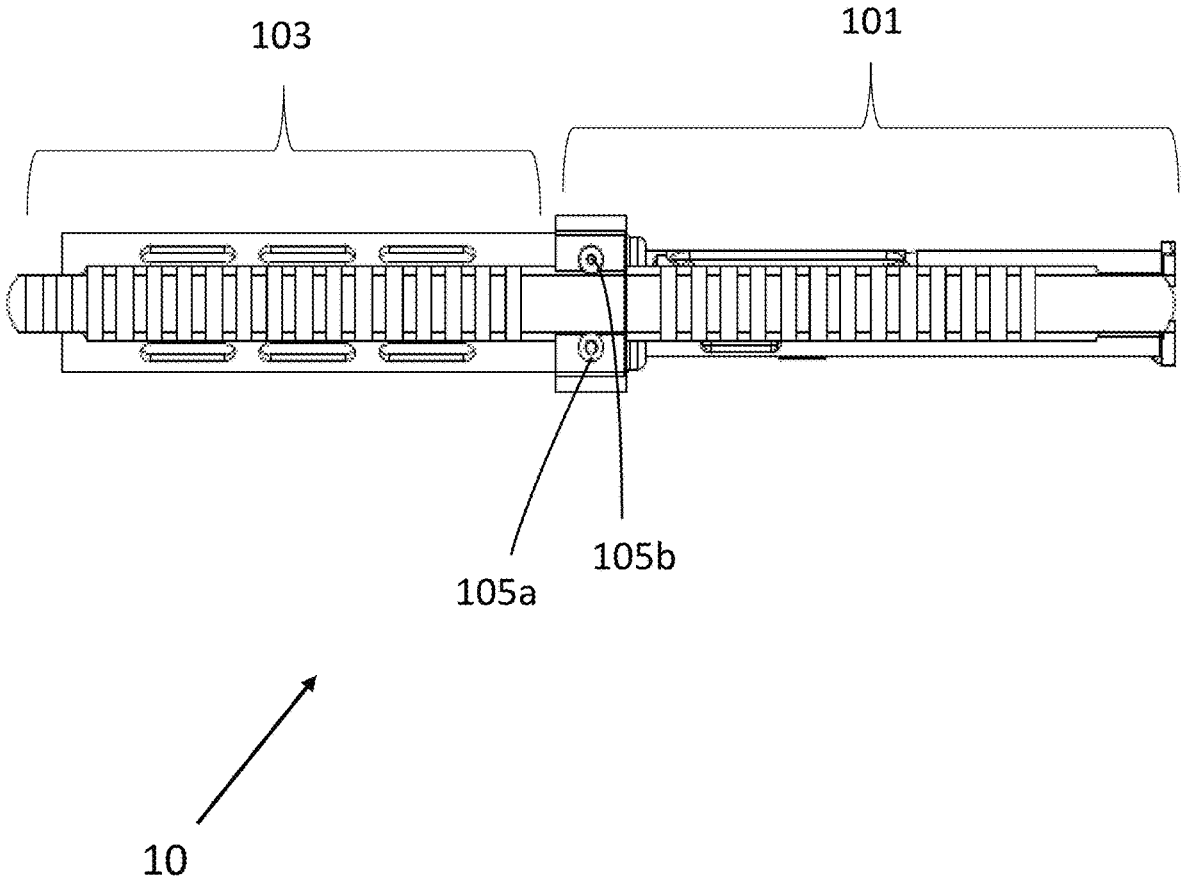
FIG. 3 illustrates a top view of the modular bushing adapter assembly.

FIG. 3 illustrates a top view of the modular bushing adapter assembly 10. An upper receiver 101 is shown operatively connected to a rail extension hand guard 103 using a plurality of extension threaded fasteners 105*a*, 105*b*.

Figure 4:
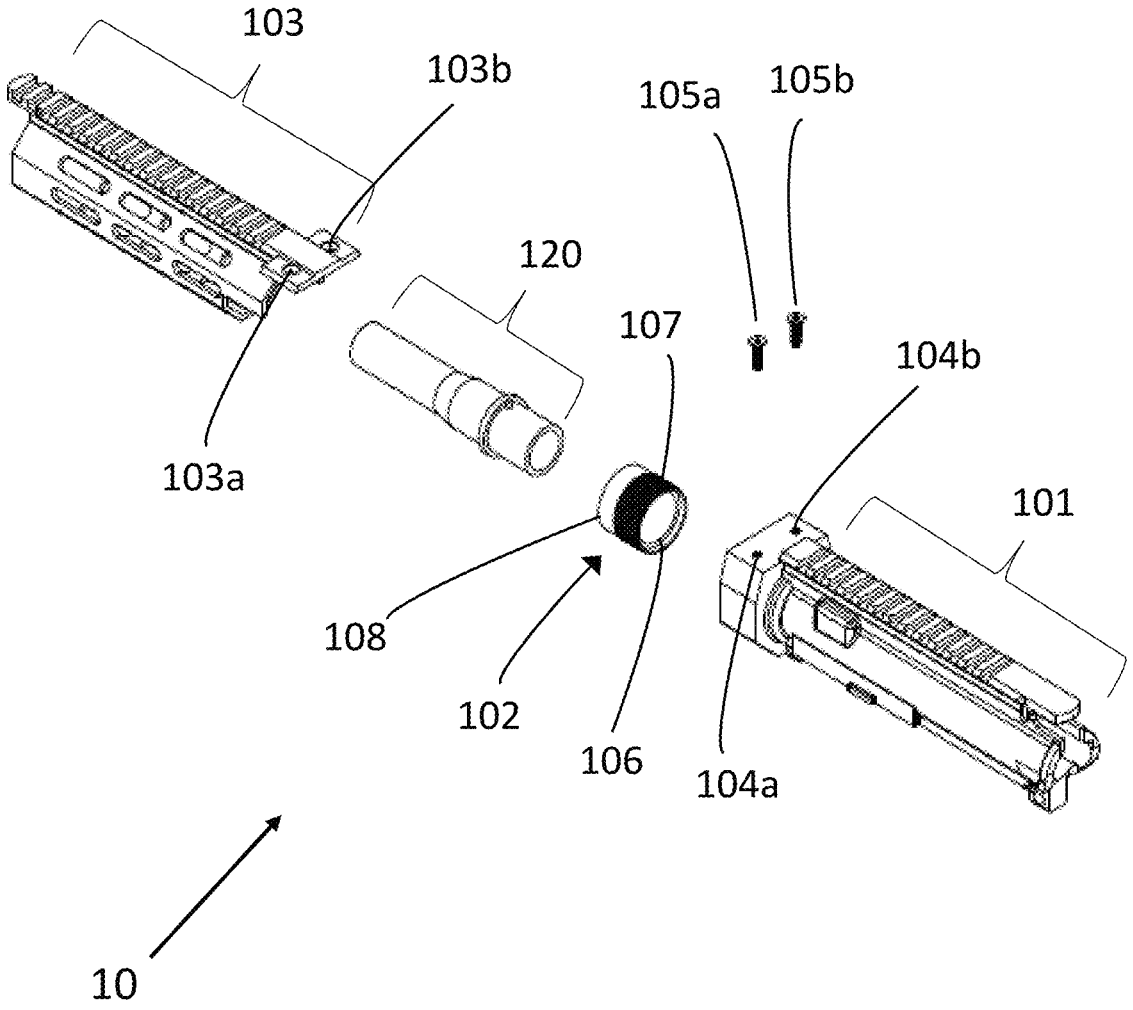
FIG. 4 illustrates an exploded perspective view of the modular bushing adapter assembly.

FIG. 4 illustrates an exploded perspective view of the modular bushing adapter assembly 10. The rail extension hand guard 103 includes an end with a plurality of holes 103*a*, 103*b*. An upper receiver 101 with internal threads is shown with a plurality of holes 104*a*, 104*b* for connecting the hand guard 103 using threaded fasteners 105*a*, 105*b*. As shown in FIG. 3, threaded fasteners 105*a*, 105*b* can pass through the hand guard holes 103*a*, 103*b* and the upper receiver holes 104*a*, 104*b* to operatively connect the hand guard 103 to the receiver 101. A barrel nut 102 includes a front (first) end 108 for connecting to a preexisting barrel 120. The novel barrel nut ("barrel bushing") 102 has a rear (second) end 106 with external threads 107 for fastening into internal threads within the upper receiver 101. The barrel 120 is a preexisting component that is commercially available in various lengths and calibers. Barrels 120 of various lengths and calibers can be interchanged using the adapter assembly 10.

Figure 5:
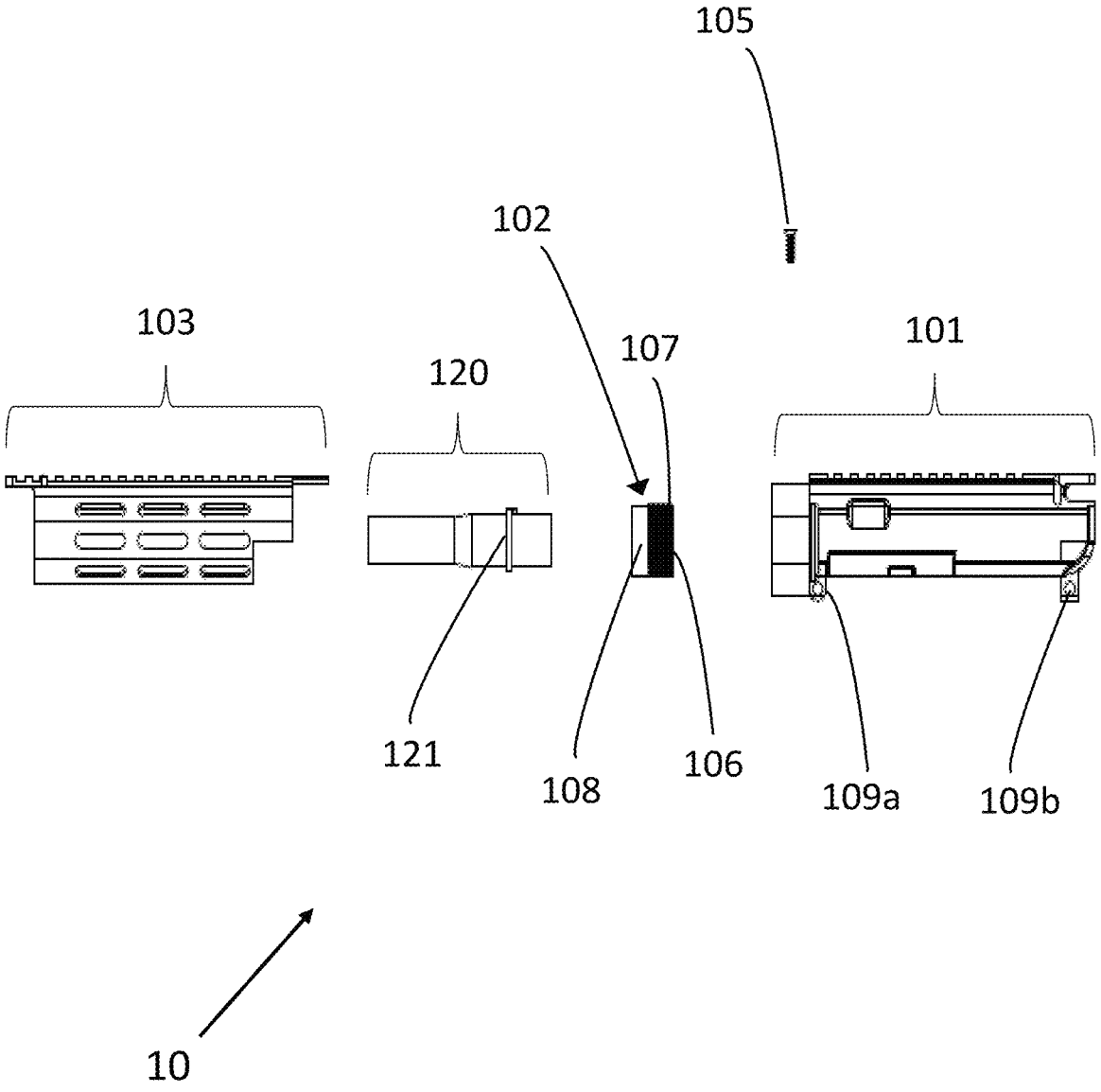
FIG. 5 illustrates an exploded side view of the modular bushing adapter assembly.

FIG. 5 illustrates an exploded side view of the modular bushing adapter assembly 10. The preexisting barrel 120 includes a flange 121 for operatively connecting to the first end 108 of the barrel nut 102. The barrel nut 102 is configured to connect and provides compression to the barrel flange 121. The compression provides rigidity installation of the preexisting barrel 120. When the adapter assembly 10 is connected, the preexisting barrel 120 also engages the hollow interface of the upper receiver 101. The barrel 120 fits inside the novel rail extension hand guard 103. The hand guard 103 is operatively connected to the upper receiver 101 along a flat plane (shown in FIG. 2). The rigid connection of the hand guard 103 and upper receiver 101 is maintained using a plurality of extension threaded fasteners 105. These threaded fasteners 105 can be bolts or screws that provide adequate compression. The rail extension hand guard 103 is designed to operatively connect to the novel upper receiver 101 but can accommodate preexisting barrels of various lengths and calibers.

The upper receiver 101 includes a plurality of receiver holes 109*a*, 109*b* that align with a plurality of holes in the lower receiver (not shown). The upper receiver 101 operatively connects to a firearm's lower receiver using a plurality of receiver threaded fasteners. The receiver threaded fasteners can be bolts or screws that provide adequate compression and rigidity for the receiver connections. The threaded fasteners can be installed and removed manually by the user without needing any additional tools.

Figure 6:
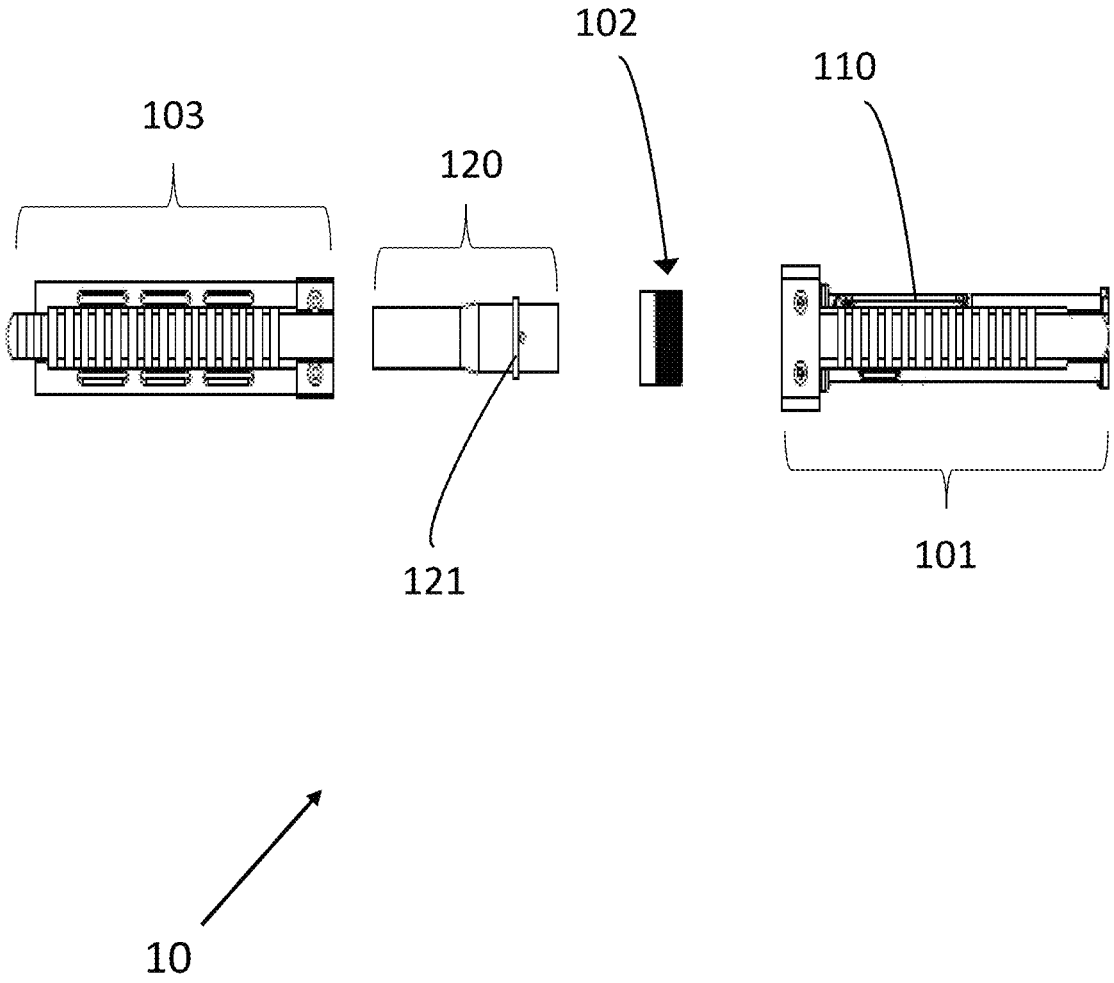
FIG. 6 illustrates an exploded top view of the modular bushing adapter assembly.

FIG. 6 illustrates an exploded top view of the modular bushing adapter assembly 10. The upper receiver 101 includes an ejection port 110. The example embodiment 10 does not include a brass deflector or a forward assist, although alternative embodiments can include those components. Optionally, a dust cover can be implemented in the upper receiver 101.

Figure 7:
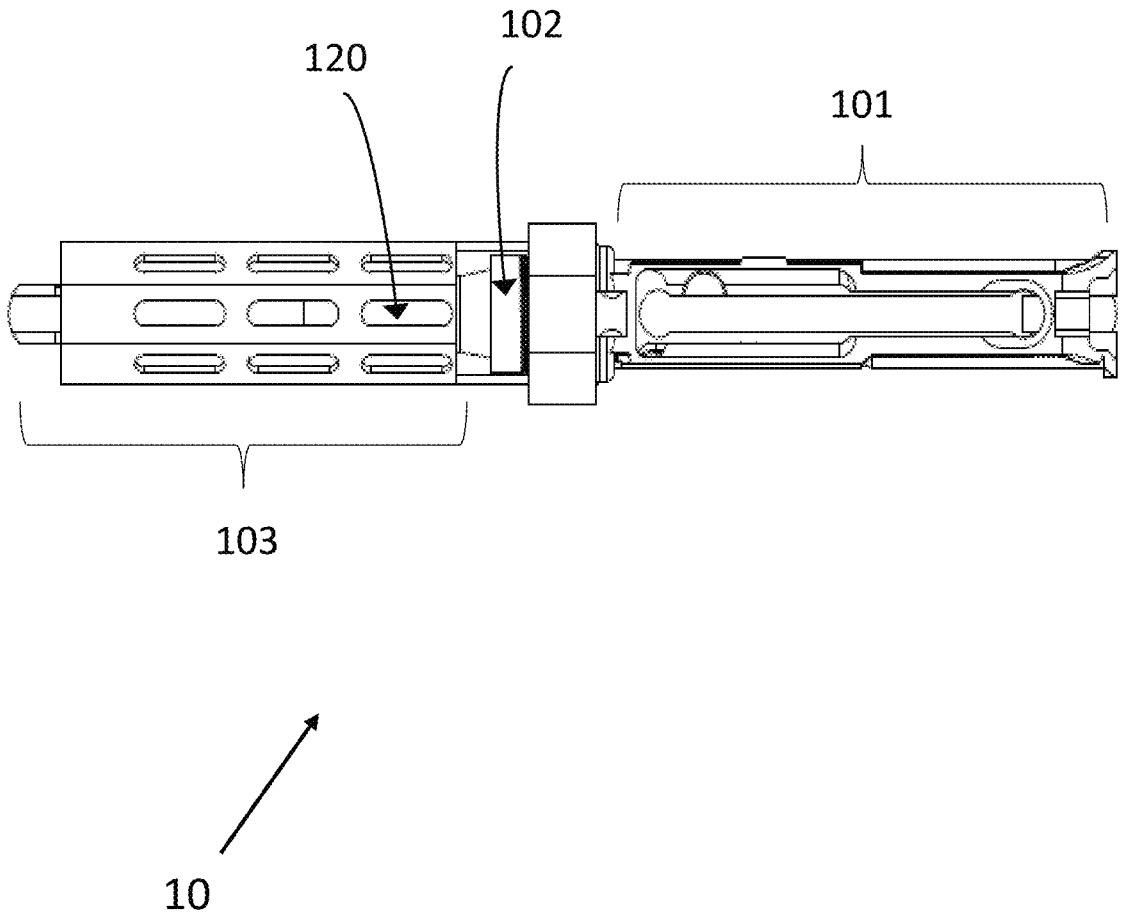
FIG. 7 illustrates a bottom view of the modular bushing adapter assembly.

FIG. 7 illustrates a bottom view of the modular bushing adapter assembly 10. As aforementioned, the preexisting barrel 120 fits inside the novel rail extension hand guard 103 and is operatively connected to the barrel nut/bushing 102 and the upper receiver 101.

Figure 8:
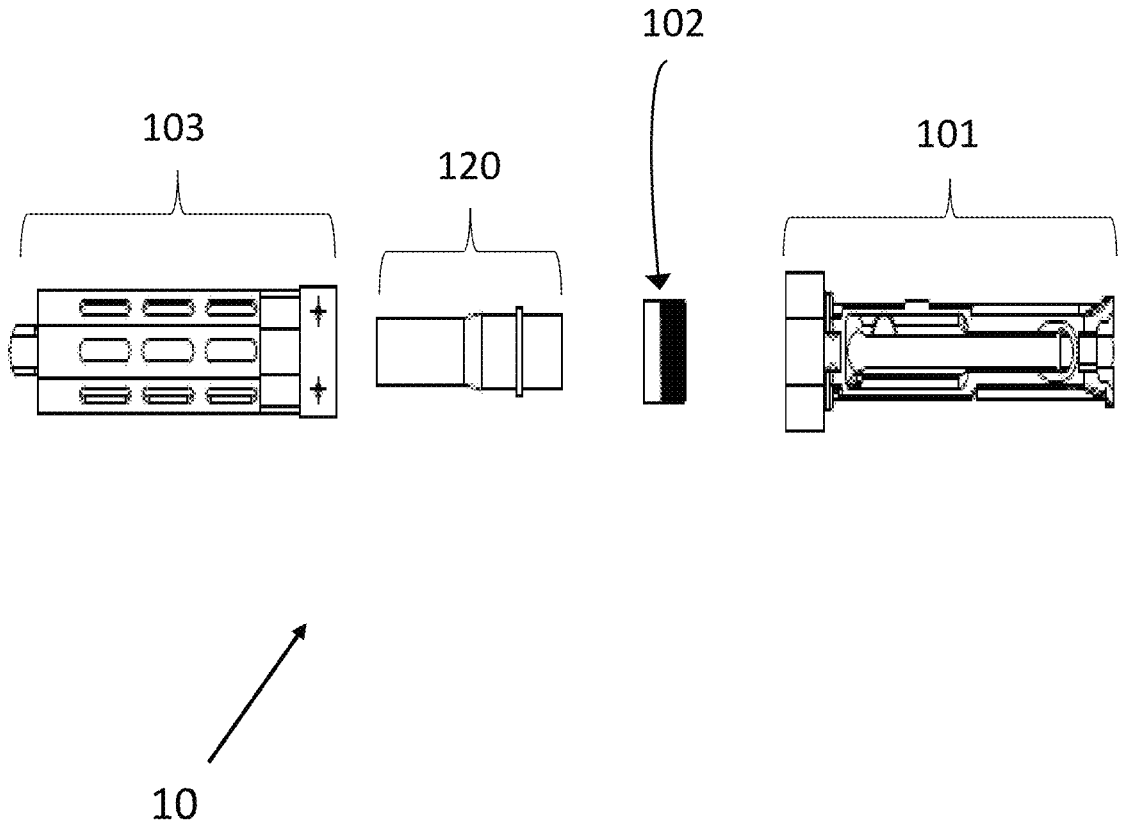
FIG. 8 illustrates an exploded bottom view of the modular bushing adapter assembly.

FIG. 8 illustrates an exploded bottom view of the modular bushing adapter assembly 10.

Figure 9:
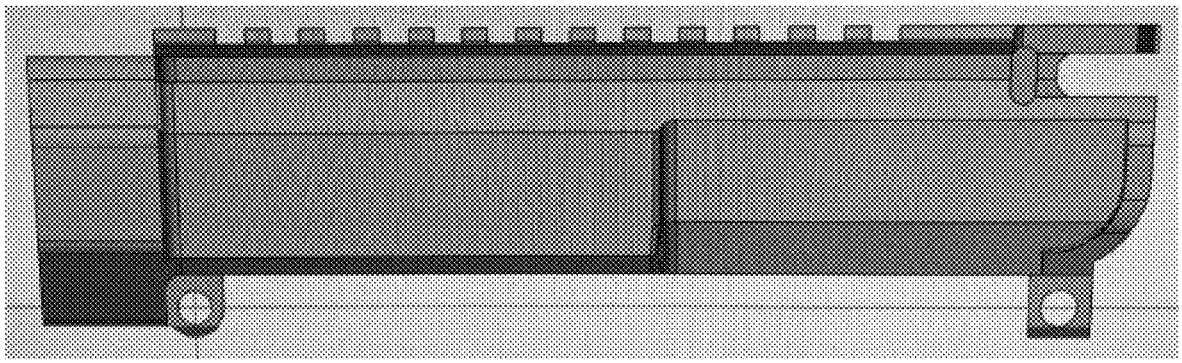
FIG. 9 illustrates a side view of an alternative modular bushing adapter assembly.

FIG. 9 illustrates a side view of an alternative modular bushing adapter assembly 20. The components in the alternative adapter assembly 20 are identical to the components in adapter assembly 10. Alternative adapter assembly 20 has a different overall shape and appearance but functions in substantially the same manner as adapter assembly 10.

The invention claimed is:

1. A firearm adapter system for interchanging a plurality of barrels, the system comprising:

a. a first barrel including a flange;

b. an upper receiver including internal threads and a plurality of holes;

c. a hand guard including a plurality of holes;

d. a plurality of threaded fasteners;

e. wherein the plurality of threaded fasteners operatively connects the hand guard to the upper receiver;

f. a barrel nut including a first end and a second end;

g. wherein the first end of the barrel nut is configured to connect to the flange of the first barrel;

h. wherein a user can manually tighten the barrel nut to provide compression to the flange of the first barrel, without needing an additional tool;

i. wherein the first barrel can be exchanged for a second barrel of a different caliber;

j. wherein the second end of the barrel nut includes external threads; and k. wherein the external threads of the barrel nut are configured to connect to the internal threads of the upper receiver.

2. The system of claim 1, wherein the barrel is a rifle barrel.

3. A firearm adapter system for interchanging barrels, the system comprising:

a. a barrel including a flange;

b. an upper receiver including internal threads and a plurality of holes;

c. a hand guard including a plurality of holes;

d. a plurality of threaded fasteners;

e. wherein the plurality of threaded fasteners operatively connects the hand guard to the upper receiver;

f. a barrel nut including a first end and a second end;

g. wherein the first end of the barrel nut is configured to connect to the flange of the barrel;

h. wherein the second end of the barrel nut includes external threads;

i. wherein the external threads of the barrel nut are configured to connect to the internal threads of the upper receiver;

j. a lower receiver including a plurality of holes;

k. the upper receiver further includes a plurality of receiver holes;

l. a plurality of receiver threaded fasteners; and m. wherein the plurality of receiver threaded fasteners operatively connect the lower receiver to the upper receiver.

4. The system of claim 1, wherein the upper receiver further includes an ejection port.

* * * * *